US007304439B2

(12) United States Patent
Tang et al.

(10) Patent No.: US 7,304,439 B2
(45) Date of Patent: Dec. 4, 2007

(54) PHASE-CONTROLLED DIMMABLE ELECTRONIC BALLASTS FOR FLUORESCENT LAMPS WITH VERY WIDE DIMMING RANGE

(75) Inventors: Pak Chuen Tang, Kowloon (HK); Yiu Hung Lam, Kowloon (HK); Shu Hung Chung, Kowloon (HK); Ron Shu-yuen Hui, Kowloon (HK)

(73) Assignee: E. Energy Technology Limited, Kowloon (HK)

( * ) Notice: Subject to any disclaimer, the term of this patent is extended or adjusted under 35 U.S.C. 154(b) by 0 days.

(21) Appl. No.: 09/948,994

(22) Filed: Sep. 6, 2001

(65) Prior Publication Data

US 2003/0080696 A1 May 1, 2003

(51) Int. Cl.
*H05B 37/02* (2006.01)

(52) U.S. Cl. ..... 315/291

(58) Field of Classification Search ..... 315/224, 315/247, 291, 307, 306, DIG. 4
See application file for complete search history.

(56) References Cited

U.S. PATENT DOCUMENTS

| | | | | |
|---|---|---|---|---|
| 4,926,097 A | | 5/1990 | Taek | 312/209 R |
| 4,998,045 A | | 3/1991 | Ruby | 315/307 |
| 5,396,155 A | | 3/1995 | Bezdon et al. | 345/291 |
| 5,422,547 A | * | 6/1995 | Brownell | 315/307 |
| 5,604,411 A | | 2/1997 | Venkitasubrahmanian et al. | 315/307 |
| 5,636,106 A | | 6/1997 | Batarseh et al. | 363/16 |
| 5,994,848 A | * | 11/1999 | Janczak | 315/224 |

(Continued)

FOREIGN PATENT DOCUMENTS

| | | |
|---|---|---|
| EP | 1 164 819 A1 | 12/2001 |
| EP | 1 209 954 A1 | 5/2002 |
| FR | 2 425 760 | 12/1979 |

OTHER PUBLICATIONS

Janczak et al., "Triac Dimmable Integrated Compact Fluorescent Lamp," *Journal of the Illuminating Engineering Society*, pp. 144-151, Winter 1998.

(Continued)

*Primary Examiner*—Shih-Chao Chen
*Assistant Examiner*—Minh Dieu A
(74) *Attorney, Agent, or Firm*—Merchant & Gould P.C.

(57) ABSTRACT

In order to achieving wide dimming range for compact and tubular fluorescent lamps, two novel control approaches are proposed. (i) Novel techniques for suppressing oscillatory effects in the Triac circuit so as to maintain stable Triac operation over a wide firing angle range and (ii) a hybrid dimming control technique in the ballast inverter circuit for achieving wide dimming range from 100% to about 3%. Concerning point (i) both dissipative and non-dissipative energy absorption schemes (EAS) are proposed to suppress the transient effects in the Triac circuit when the Triac is turned on. The essence of the EAS is to ensure that the Triac circuit can be operated in a stable manner without oscillations or inadvertent turn-off. With respect to pint (ii) a hybrid dimming method is proposed in which unlike traditional control methods that use inverter frequency control only for dimming purposes, both dc link voltage and inverter frequency are varied. The essence of the new dimming control is to reduce the range of the inverter frequency variation so that the overall dimming range can be made as wide as possible.

24 Claims, 12 Drawing Sheets

U.S. PATENT DOCUMENTS

| | | | | |
|---|---|---|---|---|
| 6,078,147 | A | 6/2000 | Arts et al. | 315/291 |
| 6,144,169 | A * | 11/2000 | Janczak | 315/224 |
| 6,172,466 | B1 * | 1/2001 | Ki et al. | 315/224 |
| 6,208,088 | B1 * | 3/2001 | Konishi et al. | 315/291 |
| 6,351,080 | B1 | 2/2002 | Birk et al. | 315/224 |
| 6,433,493 | B1 * | 8/2002 | Ilyes et al. | 315/224 |
| 6,486,616 | B1 * | 11/2002 | Liu et al. | 315/291 |
| 6,545,431 | B2 * | 4/2003 | Hui et al. | 315/291 |
| 6,597,127 | B2 * | 7/2003 | Takahashi et al. | 315/224 |

OTHER PUBLICATIONS

Ki et al., "Phase-Controlled Dimmable Electronic Ballast for Fluorescent Lamps," *Proc. IEEE Power Electron*, pp. 1121-1124, 1999.

Hui et al.., "An Electronic Ballast with Wide Dimming Range, High PF, and Low DMI", IEEE Transactions on Power Electronics, vol. 16, No. 4, Jul. 2001, pp. 465472.

Hui et al., "An Electronic Ballast with Wide Dimming Range, High PF, and Low DMI", IEEE Transactions on Power Electronics, vol. 16, No. 4, Jul. 2001, pp. 465-472.

Derwent Abstract Accession No. 2002-214177/27, Class X 26, TW 435057 A (Yang) May 16, 2001.

* cited by examiner

PHASE-CONTROLLED DIMMABLE ELECTRONIC BALLASTS FOR FLUORESCENT LAMPS WITH VERY WIDE DIMMING RANGE

FIELD OF INVENTION

This invention relates to phase-controlled dimmable electronic ballasts, for example two wired. Triac-controlled ballasts, and in particular to such ballasts that are capable of dimming fluorescent lamps over a dimming range from 100% to about 3%.

BACKGROUND OF THE INVENTION

At present there are no commercially available compact fluorescent lamps that can be dimmed by ordinary Triac dimmers from 100% to less than 3% of the lamp power. Two conditions have to be satisfied in order to use Triac dimmers to control the light intensity of fluorescent lamps with a very wide dimming range from 100% to about 3%. The first condition is that the Triac, that consists of two SCR thyristors in anti-parallel configuration, must be able to operate in a stable manner for a wide range of firing angle. The second condition is that the dimming method must be able to control the lamp power down to low level. Existing techniques can achieve dimming range from 100% to about 20% to 30%, and to date no commercially viable techniques have been developed to extend the dimming range down to around 3%.

SUMMARY OF THE INVENTION

According to the preset invention thee is provide a method of providing phase controlled dimming control of a fluorescent lamp where said fluorescent lamp is controlled by an electronic ballast connected to a mains supply through a phase control means that controls the angular range of switch-on of said supply, wherein the angular range is varied between 0° and 180°, and wherein over at least a part of the angular range the lamp power is controlled by varying both a dc link voltage and the switching frequency of said ballast.

In one preferred embodiment, the dc link voltage is maintain fixed over a first portion of the angular range and the switching frequency is varied, and over the remainder of the angular range both the dc link voltage and the switching frequency arm varied. In this embodiment the first portion may correspond to an angular range of between 0° and 90°.

Peferably the phase control means comprises a Triac, and in this embodiment means are provided for suppressing transient oscillations of the Triac circuit when the Triac is switched on. The transient oscillations may be suppressed by a dissipative energy absorption technique, or by a non-dissipative energy absorption technique, or more preferably by a combination of the two.

Viewed from another aspect the invention provides a method for providing dimming control of an electronic ballast for a fluorescent lamp wherein a Triac is provided between an ac supply and said ballast, and wherein said method includes suppressing oscillations of said Triac when said Triac is switched on by means of an energy absorption technique.

The energy absorption technique may be a dissipative energy absorption technique, a non-dissipative energy absorption technique or a combination of the two.

Viewed from another broad aspect the present invention provides apparatus for providing dimmable control of an electronic ballast of a fluorescent lamp, comprising means for connecting said ballast to an ac mains supply, phase control means connected between the input of the said ballast and said mains supply for controlling the angular range of switch-on of said mains supply, an output inverter for regulating the fluorescent lamp, and means for providing a dc link voltage to said output inverter, wherein means are provided for over at least a part of the angular range varying simultaneously both the dc link voltage and a switching frequency of said output inverter in order to provide dimming control.

In one possible embodiment when the firing angle is in a first range the dc link voltage is kept fixed and the switching frequency alone is varied, and when the firing angle is in a second range both the dc link voltage and the switching frequency are varied.

The means for providing a dc link voltage may be an input line current shaper, for example a boost converter, and when the angular range is between 0° and 90° the dc link voltage is kept fixed and the switching frequency is varied, while when the angular range is greater than 90° both the dc link voltage and the switching frequency are varied.

Preferably the phase control means comprises a Triac, and there may be further provided means for suppressing oscillations of the Triac when the Triac is switched on. This suppressing means may comprise a dissipative energy absorption means, a non-dissipative energy absorption means, or both.

Viewed from a still further broad aspect the present invention provides apparatus for providing dimmable control of an electronic ballast for a fluorescent lamp comprising, a Triac provided between an ac mains supply and said ballast, and means for suppressing oscillations of said Triac when said Triac is switched on.

The suppressing means may comprise a dissipative energy absorption means. For example the dissipative energy absorption means may comprise a resistor-capacitor-diode circuit provided between the Triac and an input line current shaper, wherein the resistor and capacitor are connected in series and the diode is connected in parallel with the resistor. Alternatively the dissipative energy absorption means may comprise a resistor-capacitor-switch circuit provided between the Triac and an input line current shaper, wherein the resistor and capacitor art connected in series and the switch is connected in parallel to the resistor whereby after the initial oscillations have been suppressed the capacitor may be tied to earth and may function as part of an EMI filter. The switch may preferably be a power Mosfet. Alternatively the dissipative energy absorption means may comprise a resistor-capacitor-inductor circuit provided between the Triac and an input line current shaper, wherein the capacitor and resistor are in series and the inductor is connected in parallel with the resistor and in series with a second resistor, whereby a the initial oscillations have been suppressed the capacitor may be tied to earth and may function as part of an EMT filter.

The suppressing means may comprise a non-dissipative energy absorption means. This non-dissipative energy absorption means may comprise means for momentarily increasing the input current of the current shaper when the Triac is turned on. The means for increasing the input current may comprises means for differentiating the input voltage to said current shaper.

More preferably still, the suppressing means comprises both dissipative and non-dissipative energy absorption means.

Viewed from a general aspect the present invention provides apparatus for providing dimming control of an electronic ballast for a fluorescent lamp, wherein said apparatus enables the lamp power to be varied over a range of from 3% to 100% of the maximum rated lamp power.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

In order to achieving wide dimming range for compact and tubular fluorescent lamps, two novel control approaches are proposed. (i) Novel techniques for suppressing oscillatory effects in the Triac circuit so as to maintain stable Triac operation over a wide firing angle range and (ii) a hybrid dimming control technique in the ballast inverter circuit for achieving wide dimming range from 100% to about 3%. Concerning point (i) both dissipative and non-dissipative energy absorption schemes (EAS) are propose to suppress the transient effects in the Triac circuit when the Triac is turned on. The essence of the EAS is to ensure that the Triac circuit can be operated in a stable manner without oscillations or inadvertent turn-off. With respect to point (ii) a hybrid dimming method is proposed in which unlike traditional control methods that use inverter frequency control only for dimming purposes, both dc link voltage and inverter frequency are varied. The essence of the new dimming control is to reduce the range of the inverter frequency variation so that the overall dimming range can be made as wide as possible.

Figure 1:
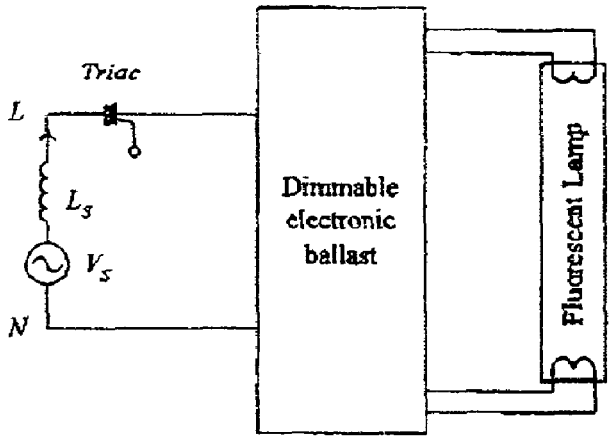
FIG. 1 shows the basic wiring diagram of a fluorescent lamp with a triac-controlled dimmable ballast.

As shown in FIG. 1, input of the ballast is connected to the ac mains through a Triac. The power of the fluorescent lamp (or the lux level of the fluorescent lamp) is controlled by adjusting the firing angle of the Triac.

Figure 2:
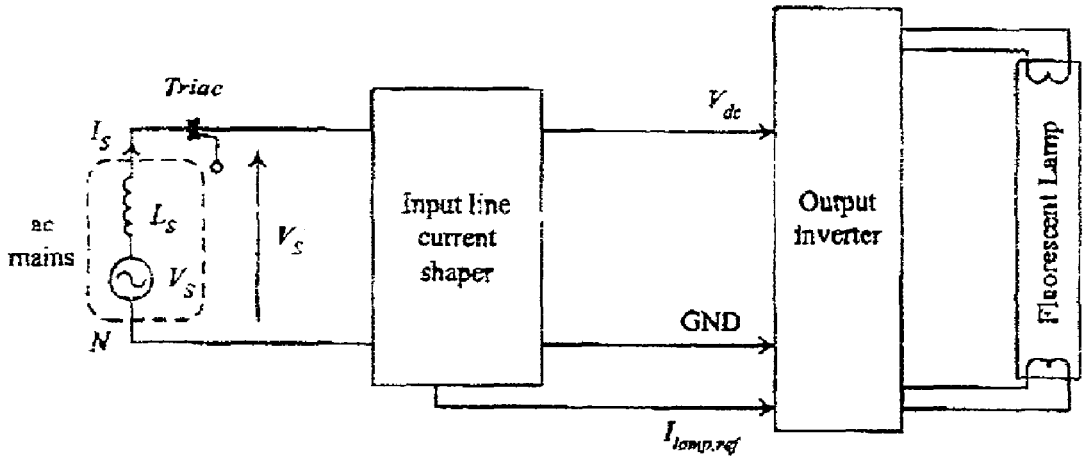
FIG. 2 is a functional block diagram of a dimmable electronic ballasts according to an embodiment of the invention, FIGS. 3(*a*) and (*b*) illustrate a hybrid control method of the present invention, FIGS. 4(*a*)-(*c*) show schematically (a) an input line current shaper for use in an embodiment of the invention, (b) a general transient energy absorption principle, and (c) an alternative general transient energy absorption principle.

A dimmable electronic ballast of the present invention may comprise two main stages, the input line current shaper and the output inverter, and a functional block diagram of this structure is shown in FIG. 2. $L_S$ is the source inductance of the supply mains. The function of the current shaper is to shape the line current $I_S$ in the same profile as the output voltage $V_S'$ of the Triac and thus the input resistance of the current shaper is always resistive.

The output inverter stage regulates the fluorescent lamp current to a reference value $I_{lamp,ref}$, which is derived from the input phase-controlled ac voltage $V_S'$. The two stages are inter-linked by a dc link $V_{dc}$ and a lamp current reference $I_{lamp\ ref}$.

In preferred embodiments of the present invention a hybrid dimming control is provided that requires both the dc link voltage and inverter frequency to be varied. The way the dc link voltage and inverter frequency are varied depends on the choice of circuit topology for the input current shaper. In some cases, both the dc link voltage and the inverter frequency can be varied together over the entire firing range, while in other cases only the inverter frequency is varied (whilst the dc link voltage is kept constant) over a portion of the firing angle range, and both the dc link voltage and inverter frequency are varied over the other portion of the firing angle range.

One choice for the input current shaper is to use a boost converter, and this will be used as an example to illustrate the use of the hybrid dimming method. In the following an ac mains of 220V and 50 Hz is assumed.

Figure 3A:
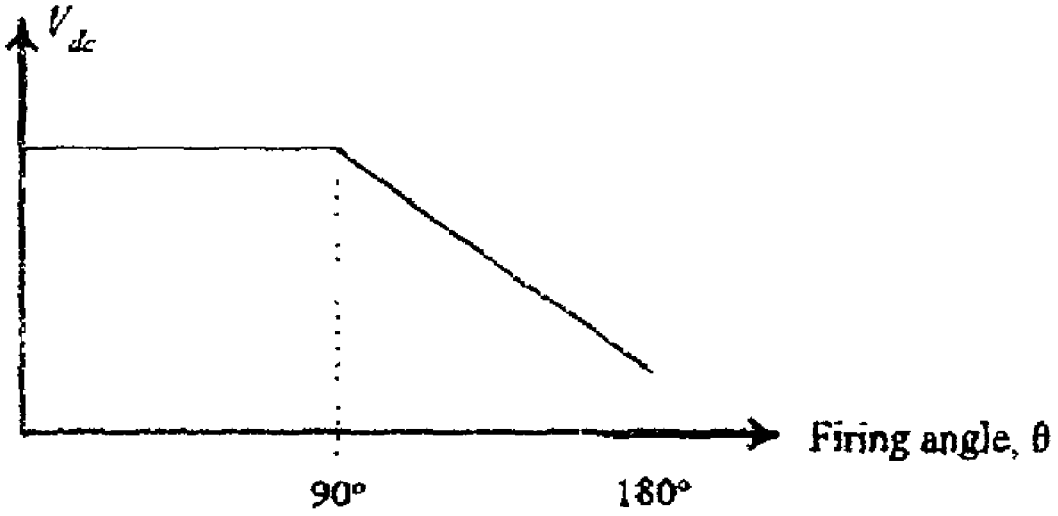
Figure 3B:
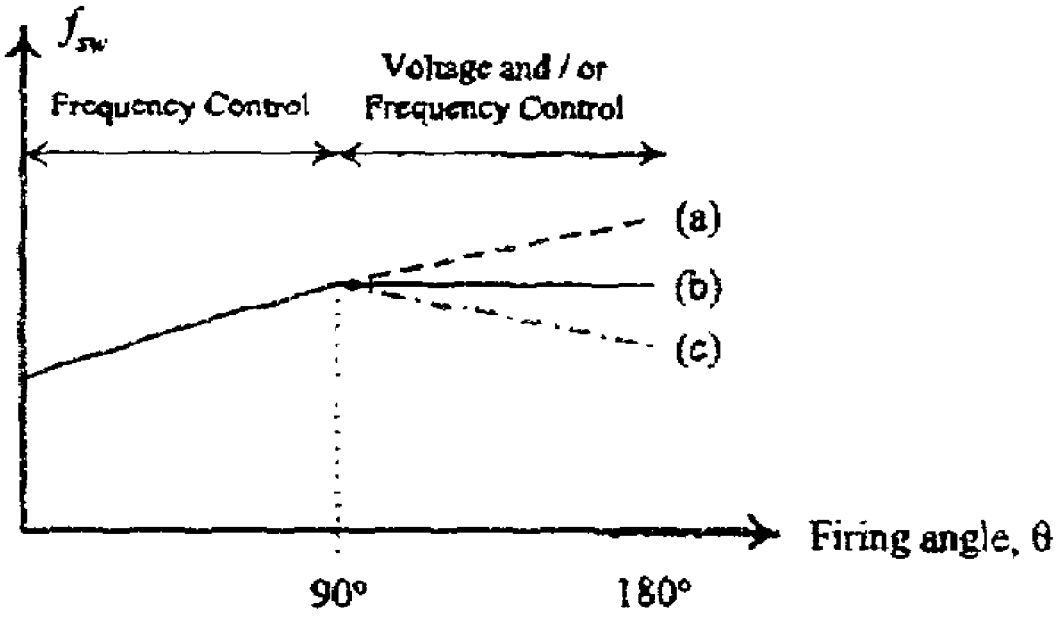

As illustrated in FIG. 3(*a*), $V_{dc}$ is kept constant by the input line current shaper when the firing angle θ of the Triac is $0 \leqq \theta \leqq 90°$ and decreases when $\theta > 90°$. For $0 \leqq \theta \leqq 90°$ (as shown in FIG. 3(*a*)), $V_{dc}$ is kept constant and the switching frequency $f_{sw}$ of the output inverter is increased as θ is increased in order to reduce the lamp power. That is, for $0 \leqq \theta \leqq 90°$, dimming control is achieved by frequency control. For $\theta > 90°$ (as illustrated in FIG. 3(*b*)), the dc link voltage $V_{dc}$ is decreased and $f_{sw}$ is also varied in order to control the lamp power (increased (curve (a)), unchanged (curve (b)), or decreased (curve (c)). Dimming control for this part of the firing range of the Triac is thus achieved by both dc link voltage control and frequency control.

Figure 4A:
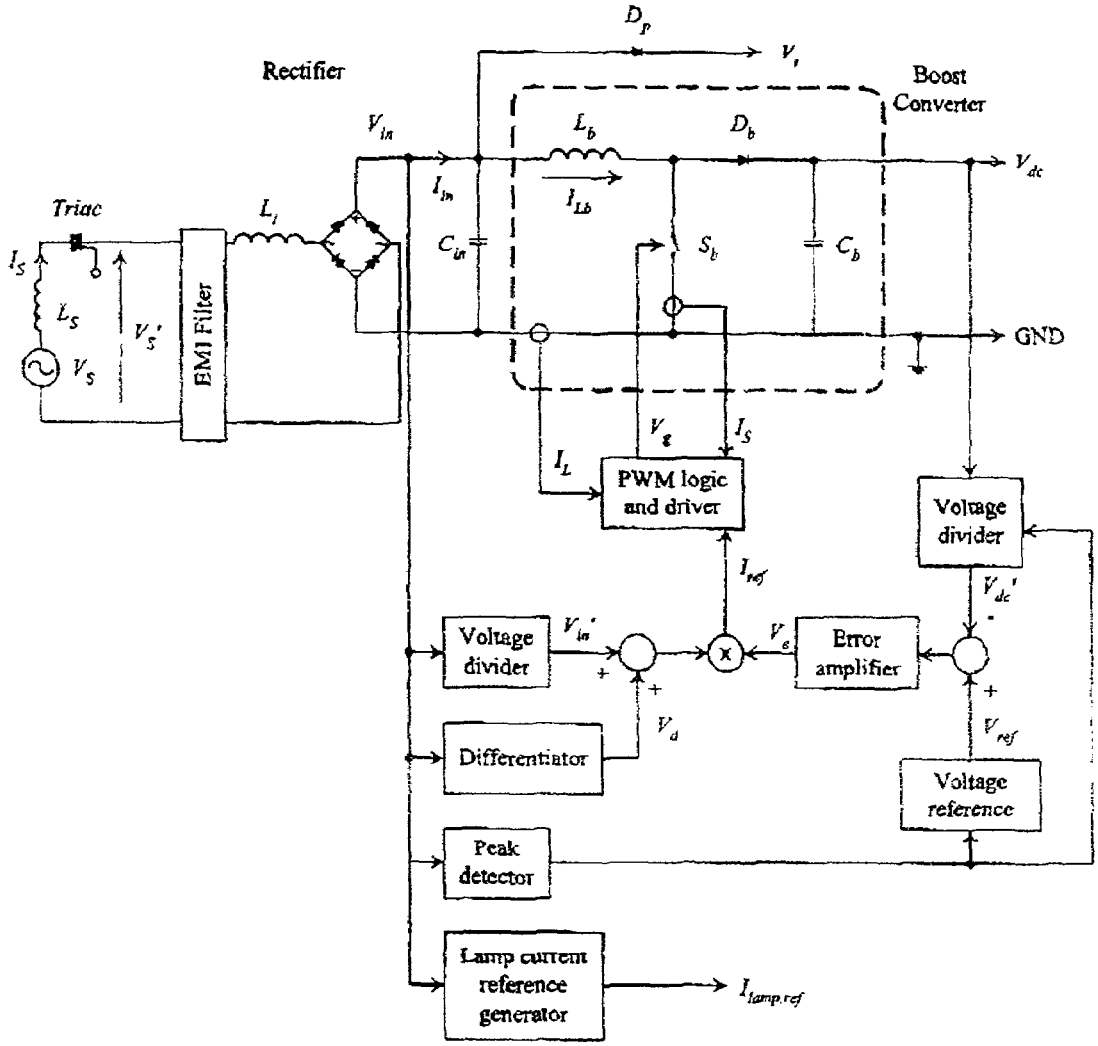
Figure 4B:
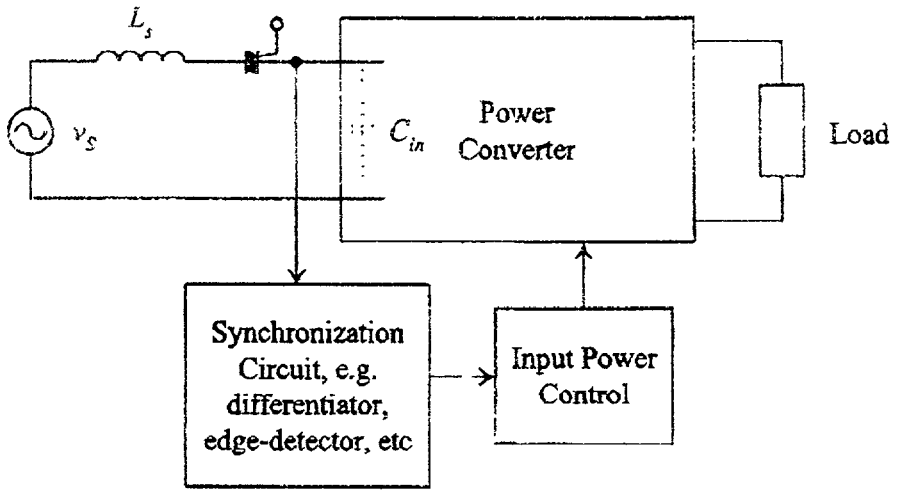
Figure 4C:
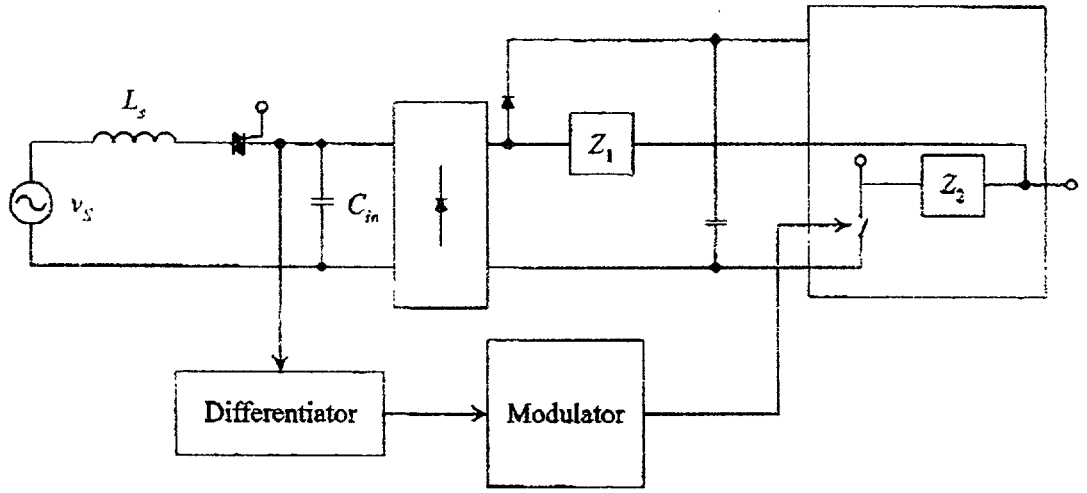

Using a hybrid control mode is advantageous because a. During the light load condition (for example, 5% of 25 W), the required power is only a few Watt and the firing angle of the Triac is very large. Since the Triac output voltage is low, the efficiency of the input current shaper, which is normally a boost converter, is low if the boost dc voltage is too high compared with the input voltage. Reduction of the dc Link voltage can reduce the power loss of the input line current shaper.

b. The sensitivity of the frequency-controlled ballast in the output inverter is smaller. If the dc link voltage decreases, the variation range of the switching frequency of the inverter will also decrease, making it possible to achieve very wide dimming range within a practical limit of variation of the inverted frequency c. With the addition of dc link voltage control to the inverter frequency control for $\theta>90°$, the filament power can easily be maintained almost constant throughout the dimming range, A. Input Line Current Shaper The schematic of the input line current shaper is shown in FIG. 4(*a*). The power circuit of the shaper consists of the following parts:

1. Electromagnetic interference (EMI) filter—this is used to suppress the high-frequency noise that is generated by the ballast from getting into the supply mains.
2. Input inductor $L_i$—this is used to provide minimum inductance in the input circuit. It can also increase the characteristic impedance of the input circuit, so that the amplitude of the current ringing that occurs at Triac switching can be reduced.
3Diode bridge—this is a full-wave rectifier. Its major function is to rectify the phase-controlled ac voltage $V_S'$ into a dc voltage $V_{in}$.
4. Current shaping circuit—Its major function is to shape the input current $I_{in}$ to follow the waveform of $V_{in}$, and thus the source current (i.e., $I_S$) will follow the profile of $V_S'$. FIG. 4(*a*) shows a boost type dc/dc converter, which is commonly used for power factor correction. It ensures that the input current of the boost converter follows the rectified input voltage. Moreover, a stable dc voltage $V_{dc}$ is regulated at the output. Apart from boost type converters, other converter topologies such as SEPIC, flyback and Cuk converters with appropriate control methods can also be used for this input current shaping function. The input capacitor $C_{in}$ is used to filter the voltage ripple caused by the converter.

Circuit Operations

The circuit operations are described by considering the circuit responses in one half cycle of the ac line frequency. FIG. 4(*a*) is used to depict the ballast operation under steady state. The transient operations are illustrated with the help of the equivalent circuit shown in FIG. 5, in which the Triac is represented by an SCR thyristor and the rectified phase-controlled voltage source $V_{S,rect}'$ is considered. The steady state and transient operations are described as follows.

Steady-State Operation

As shown in FIG. 4(*a*), $I_{in}$ is controlled to follow the waveform of $V_{in}$, ad $V_{dc}$ is regulated at a required voltage level within a specified tolerance as depicted in FIG. 3. A current controller is used to control the switching pattern of the main switch $S_b$ (using a gating signal $V_g$). This compares $V_{dc}'$ (i.e., scaled-down value of $V_{dc}$) with a reference voltage $V_{ref}$. The current reference $I_{ref}$ generated by multiplying the output voltage error (i.e., $V_a$) to an input voltage (i.e., $V_{in}$) profile, which is the sum of the scaled-down voltage of $V_{in}$ (i.e., $V_{in}'$) and a transient voltage pulse $V_d$ obtained via a differentiator or a pulse generator at the turn on moment of the Triac. The power switch $S_b$ is switched in such a way to shape the profile of the inductor current $I_{Lb}$ so that the waveform of the input current $I_{in}$ of the boost converter can be shaped to follow the waveform of $V_{in}$. $C_{in}$ is used to filter the voltage ripple of $V_{in}$.

In order to control the dc link voltage $V_{dc}$ profile as shown in FIG. 3, a peak detector, which extracts the maximum value of $V_{in}$, controls the magnitude of $V_{ref}$ and the ratio of $V_{dc}$ to $V_{dc}'$ (denoted by $\eta$). Thus, $V_{ref}$ and $\eta$ are fixed for $0 \leqq \theta \leqq 90°$. In order to reduce $V_{dc}$ for $\theta>90°$, $V_{ref}$ and/or $\eta$ can be reduced, depending on $V_{in}$. $V_{in}$ is also used to generate the required lamp current reference to the output inverter.

Transient Operation

Figure 5:
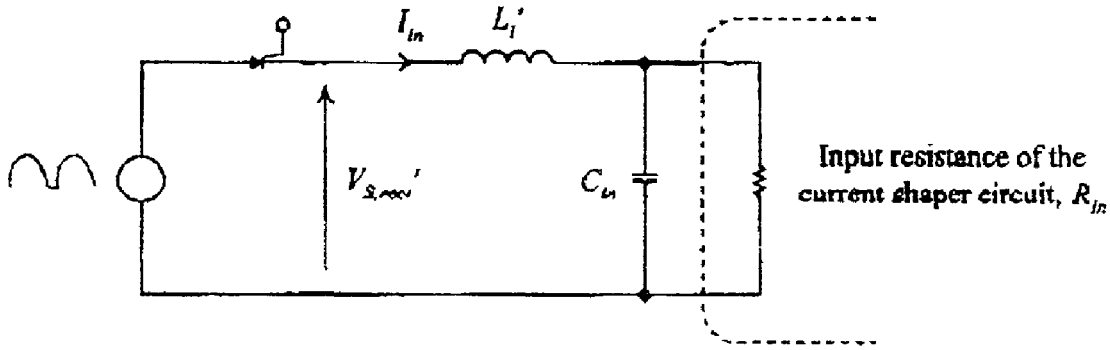
FIG. 5 shows the equivalent circuit of the current shaper of FIG. 4, FIGS. 6(*a*)-(*d*) illustrate four differ dissipative energy absorption schemes.
Figure 6A:
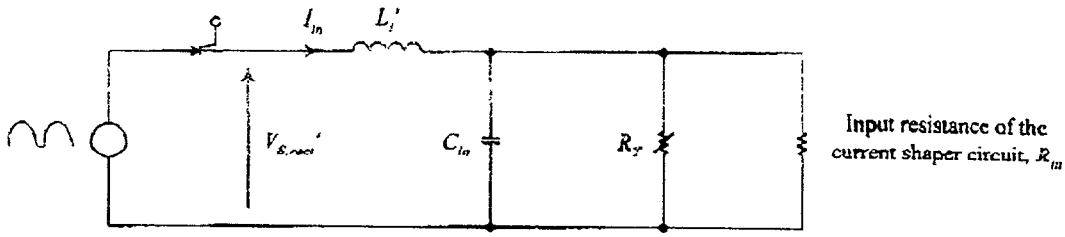
Figure 6B:
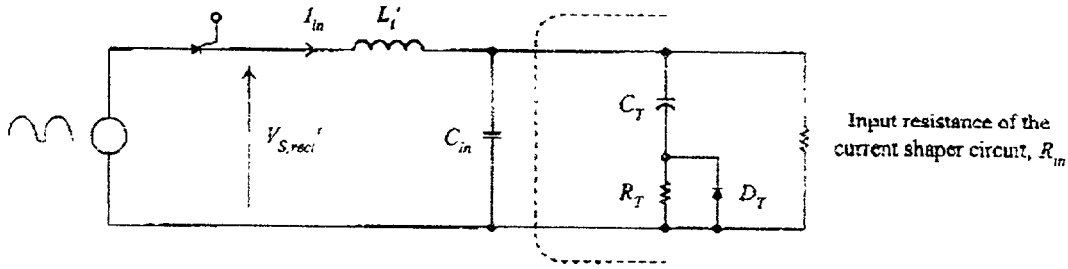
Figure 6C:
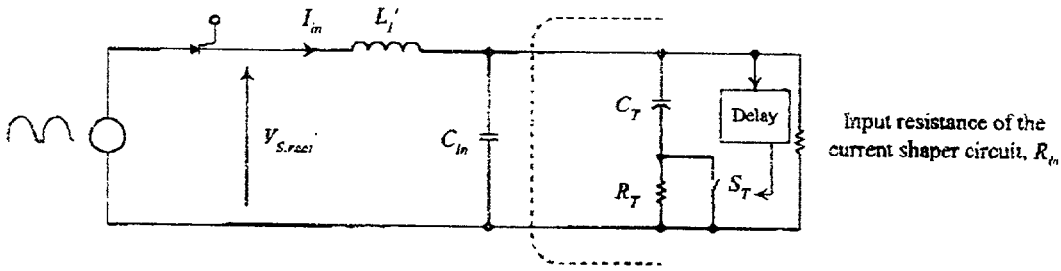
Figure 6D:
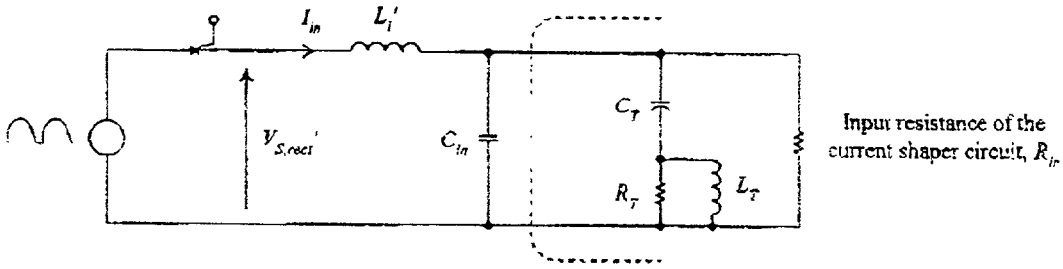

FIG. 4(*a*) can be simplified as an equivalent circuit shown in FIG. 5. As illustrated in FIG. 5, $L_i'$, $C_{in}$, and $R_{in}$ form a damped resonant circuit, where $L_i'=L_i+L_S$, where $L_S$ is the ac source inductance. The transient period begins when the Triac is switched on, because the voltage $V_{S,rect}'$ is applied to the equivalent LC circuit. Both $I_{in}$ and the voltage across $C_{in}$ have transient ringing, when the Triac is turned on in order to ensure that the Triac will not be inadvertently turned off, $I_{in}$ must not be zero or negative when the Triac is nominally turned on. Otherwise, the conducting SCR thyristor in the Triac will be turned off during the nominally 'on' period. The damping factor of the resonant circuit is dependent on the value of the equivalent load $R_{in}$. To avoid, or at least minimise, such problems caused by transient ringing, a transient energy absorption approach is provided. This approach can be realized with several energy absorption schemes (EAS), both dissipative and non-dissipative, as will be discussed further below. The objective is to make the equivalent resistance across $C_{in}$ small, so that the transient energy can be absorbed and the oscillatory ringing reduced.

Dissipative Energy Absorption Schemes

To provide a dissipative method, a circuit for dissipating part of the transient energy and shown in FIG. 6(*a*) can be added across $C_{in}$. A resistor-capacitor-diode (RCD) snubber circuit formed by $R_T$, $C_T$ and $D_T$ in FIG. 6(*b*) is illustrated. When $V_{in}$ is suddenly increased, $D_T$ is open and the impedance of $C_T$ is small (and negligible). At the moment when $V_{in}$ is applied, the effective resistance across $C_{in}$ is equal to $R_{in}$ in parallel with $R_T$ (i.e., $R_{Id}//R_T$). Thus, part of the resonant energy is dissipated in $R_T$ and the resonance is damped. As a result, both the voltage and current ringing magnitudes in the LC circuit are reduced. $D_T$ is used as a discharging path for $C_T$ so as to reduce the power loss in the snubber resistor $R_T$.

Another circuit that can implement similar functions as RCD circuit is shown in FIG. 6(*c*). This is known as a RCS circuit and comprises one resistor, one capacitor, and one switch. The switch $S_T$ is momentarily turned off when the Triac is turned on. A delay control is used to ensure that the transient ringing finishes before $S_T$ is turned on. Hence, the input transient ringing will be damped by the $R_T$. Then, $S_T$ is maintained in the 'on' state so that the $C_T$ also plays an additional role as an EMI filter. A practical way to implement the RCS circuit is to use a power Mosfet for $S_T$. In this way, the power Mosfet with an inherent anti-parallel diode provides the combined functions of both RCD and RCS circuits.

Apart from using an active component, the diode D. in FIG. 6(*b*) and the switch $S_T$ in FIG. 6(*c*) can be replaced with an inductor $L_T$. The circuit is shown in FIG. 6(*d*). When the Triac is turned on, the transient inductor current is approximately equal to zero because a back electromotive force will be generated across the inductor. The inductor path is considered to be open-circuited. After the switching transients, the inductor will become a short circuit path. Thus, $L_T$ serves the function of $D_T$ and $S_T$.

It should be noted that the dissipative EAS alone may not be sufficient for suppressing the transient effects for a wide phase angle range of the Triac. Preferably therefore a non-dissipative EAS may be used in order to effectively suppress the transient effects for stable Triac operation.

Non-Dissipative Energy Absorption Scheme

When the Triac is turned on, the voltage is applied to the power converter and the load. The presence of the source inductance and input capacitance forms a resonant circuit.

When the voltage is applied across the input inductance and capacitance, some oscillatory effects usually occur. The principle of a non-dissipative transient energy absorption scheme is to absorb the transient energy in the power converter and/or the load as shown in FIG. 4(*b*). With the use of a synchronization circuit (such as a differentiator or an edge detector), the turn-on moment of the phase-controlled circuit such as a Triac can be detected. The synchronization circuit then generates a control signal to the input power control circuit for momentarily increasing the input demand of the power converter from the supply mains. This sudden increase in extra demand enables the power converter and/or the load to absorb the transient energy and suppress the transient ringing effects. In is way, the input current will not swing to zero or negative and the Triac will not be turned off inadvertently.

Figure 7:
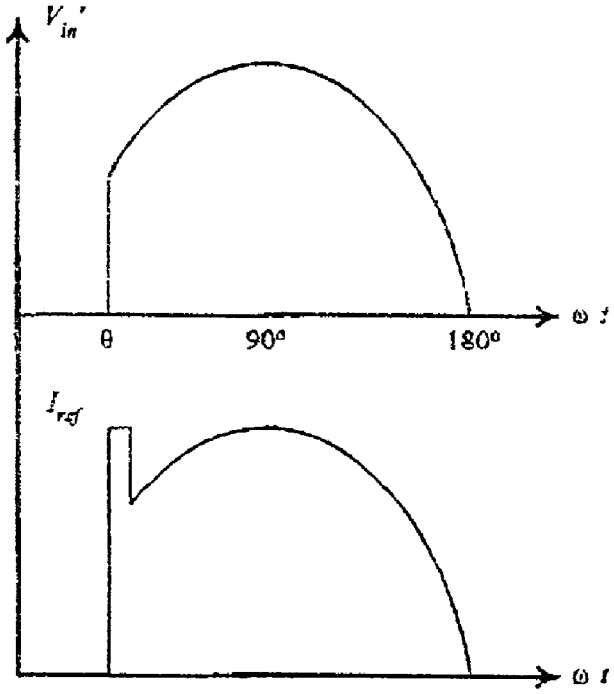
FIG. 7 illustrates a non-dissipative energy absorption scheme.

FIG. 4(*a*) shows a particular implementation of this concept that transfers the transient energy into the output capacitor of the input current shaper by momentarily reducing the input resistance of the current shaper. This can be achieved by detecting the rising voltage edge of $V_{in}$ and momentarily increasing the current reference in FIG. 4(*a*). FIG. 7 illustrates the resulting $I_{ref}$ and $V_{in}'$. The method can be implemented by differentiating $V_{in}$, so that a small transient pulse $V_c$ will be generated when the Triac is turned on (FIG. 4(*a*)). $V_d$ will then be superimposed on $V_{in}'$ to generate $I_{ref}$. The extra current demand at the Triac's turn-on enables more energy to be transferred to the output capacitor of the current shaping circuit. Thus, this method transfers the resonant energy to the dc fink capacitor and is non-dissipative. This non-dissipative EAS can be implemented by using a differential circuit at the current reference circuit of the input line current shaper as shown in FIG. 4(*a*).

As $V_{in}$ may be higher than $V_{dc}$ during the transient period because of resonance, the boost converter in FIG. 4(*a*) may not be operated properly. (For a boost converter, the output voltage should be higher than the input voltage.) A possible method of ensuring normal boost converter operation is to set the dc link voltage reference (i.e., $V_{ref}$ in FIG. 4(*a*)) higher than normal during the transient period, so that $V_{dc}$ could be higher than the voltage ringing in $C_{in}$.

Figure 8:
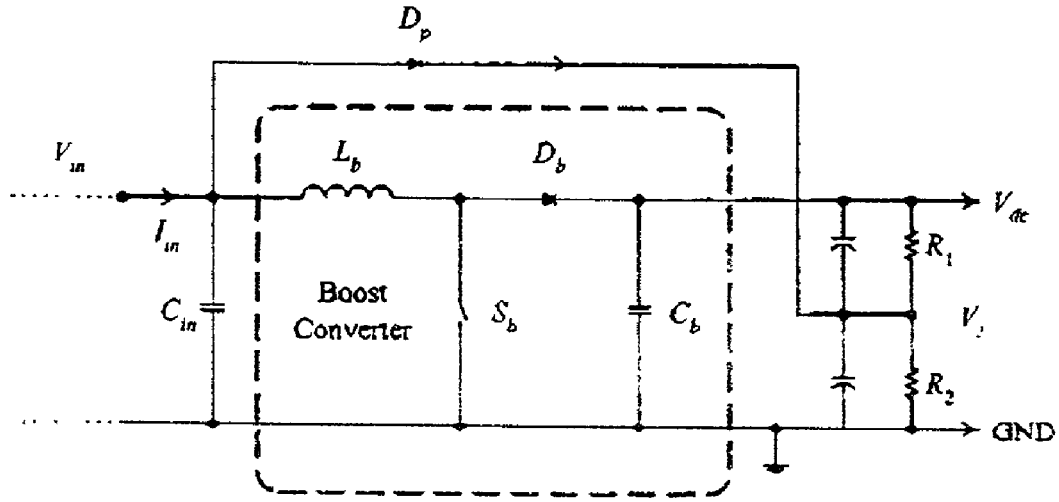
FIG. 8 illustrates an alternate non-dissipative energy absorption scheme.

Another method is to use a clamping diode $D_p$ shown in FIG. 4(*a*) and FIG. 8 to clamp $V_{in}$ to $V_t$ (which is smaller than $V_{dc}$). The boost converter can therefore perform normal voltage boosting operation during the transient period. $V_t$ can be derived form a node in the power circuit. For example, $V_t$ is a voltage node divided from $V_{dc}$, as illustrated in FIG. 8.

The transient energy can also be absorbed in the second power stage or the load as shown in FIG. 4(*c*). This is a particular example showing how the transient energy absorption scheme can be applied to some electronic ballast circuits. The example shows an electronic ballast using a charge pump circuit. A differentiator is used as the synchronization circuit to detect the turn-on moment of the Triac and gives a command to the modulator to increase the input current demand at the on time of the Triac. By controlling the switching frequency of the switch shown FIG. 4(*c*), the impedance Z1 and Z2 of the power circuit can be varied and the transient energy can be directed to and absorbed in the power circuit and the load.

Transient energy (when the Triac is turned on) can be absorbed, either in the current shaping circuit and/or the inverter circuit. Both the dissipative and non-dissipative EASs can be used separately or together to provide effective transient suppression for stable Triac operation. However, the combined use of both dissipative and non-dissipative EAS provides a more effective transient suppression than using only one of them.

Apart from the EAS, another method of minimizing current ringing is to ensure sufficient initial voltage ($V_{C,0}$) on $C_{in}$ can be maintained before the Triac is switched on (FIG. 5). If $C_{in}$ is partially charged, the resonance effect is reduced. The ringing magnitude of $I_{in}$ depends on the magnitude of $V_{S,rect}'$ during switching (i.e., $V_{S,rect}'(0)$) and the initial voltage on $C_{in}$ prior switching. For the sake of illustration, it is assumed that the input resistance of the input current shaper is infinite. It can be shown that the swinging component of $I_{in}$ will swing between $\pm\hat{I}_{in}$, where $$\hat{I}_{in} = \frac{V_{S,rect}(0) - V_{C,0}}{\sqrt{L_i / C_{in}}}$$

Thus, $\hat{I}_{in}$ decreases as $V_{C,0}$ increases. A possible method is to control the switching duration of $S_b$ so that the current shaper will stop operating when $V_{C,0}$ is smaller than a value, determined by $$I_{in}(t)-\hat{I}_{in}>0 \Rightarrow V_{C,0}>V_{S,rest}'(0)-I_{in}(t)\sqrt{L_i/C_{in}}$$

where $I_{in}(t)$ is the steady state value of $I_{in}$.

Figure 9:
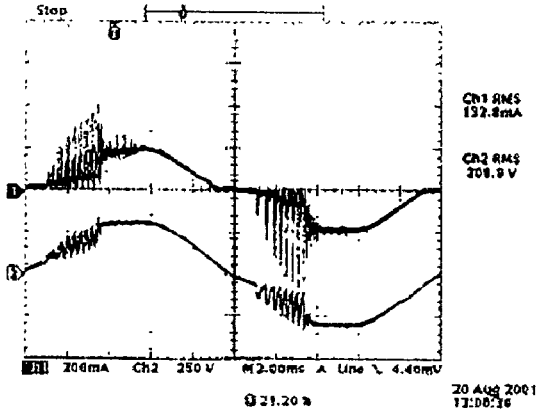
FIG. 9 shows plots of measured voltage and current at the Triac output without energy absorption, FIGS. 10(*a*) and (*b*) show plots of measured voltage and current at the Triac output with dissipative energy absorption alone, FIGS. 11(*a*) and (*b*) show plots of measured voltage and current at the Triac output with dissipative and non-dissipative energy absorption.

An experimental setup has been used to evaluate the performance of the EAS. A 25 W compact fluorescent lamp (CFL) was used as the load. The ac mains voltage is 220V, 50 Hz. A Triac dimmer is used to control the dimming of the CFL with the control scheme described in FIG. 4. FIG. 9 shows the measured current and voltage at the output of the Triac (FIG. 4) without using the proposed EAS. It can be seen that the Triac circuit is unstable. The transient effects cause both voltage and current to oscillate. When the current becomes zero or negative, the Triac turns off inadvertently.

Figure 10A:
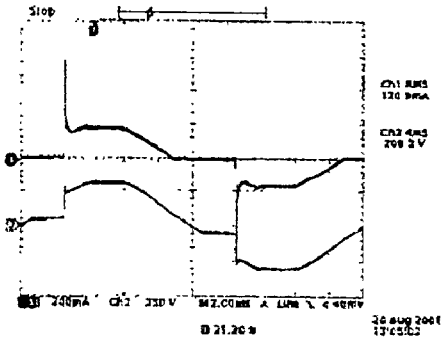
Figure 10B:
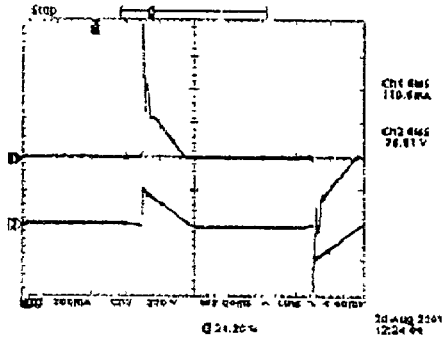

A second set of tests were performed using dissipative EAS. Using a Power Mosfet as $S_T$ in the RCS circuit, the resultant circuit has the combined functions of the RSD and RCS circuits. FIG. 10(*a*) shows the measured current and voltage waveforms at the output of the Triac when the firing angle was set at about θ=45°. The corresponding results at a firing angle of θ=135° are shown in FIG. 10(*b*). Compared with FIG. 9, it can be seen that most of the transient effects were suppressed by the proposed dissipative circuit, although some small oscillatory effects can still be observed from the measured current waveform at θ=135°.

Figure 11A:
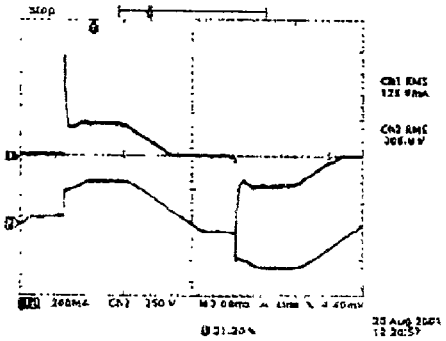
Figure 11B:
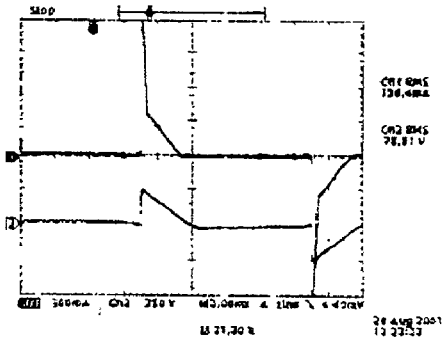

A third set of tests were carried out to evaluate the effectiveness of both dissipative and non-dissipative EAS. FIG. 11(*a*) and FIG. 11(*b*) show the measured current and voltage of the Triac output at at θ=45° (FIG. 11(*a*)) and at θ=135° FIG. 11(*b*)) respectively. By momentarily increasing the current reference $I_{ref}$ at the moment when the Triac is turned on, it can be seen that the transient effect are further suppressed. This demonstrates the effectiveness of the combined use of the proposed dissipative and non-dissipative EAS. This non-dissipative FAS allows the Triac dimmer to operate over a wide phase angle range without inadvertent turn-off.

B. Output Inverter

Figure 12:
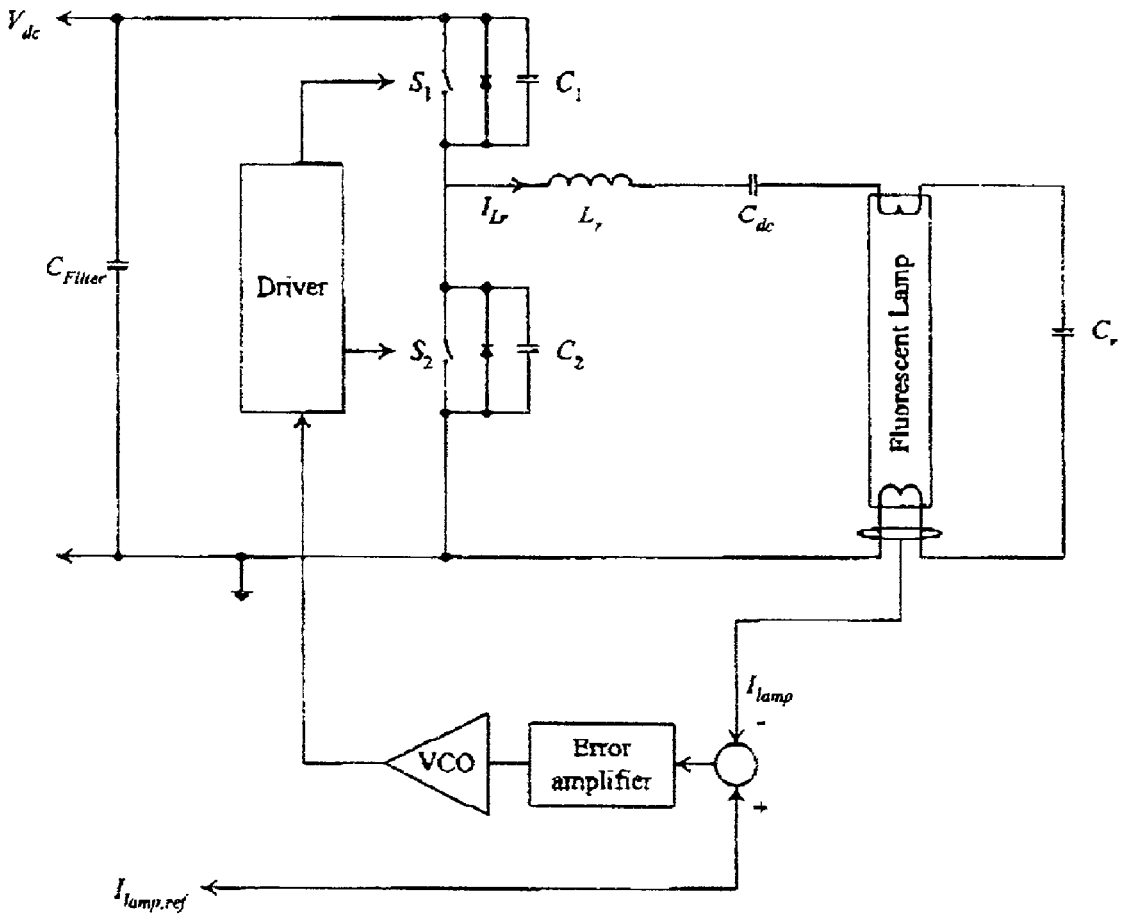
FIG. 12 shows schematically an output inverter for use in the present invention, FIGS. 13(*a*) and (*b*) show plots of (a) light intensity and (b) lamp power as a function of Triac firing angle in an embodiment of the present invention, FIGS. 14(*a*) and (*b*) show plots of (a) light intensity and (b) tamp power as a function of Triac firing angle in an embodiment of the present invention using lamp power linearization.

The voltage-fed half-bridge series-resonant parallel-loaded inverter (HBSRI) shown in FIG. 12 is powered by the output do link voltage source of the input current shaper and is used to control the dimming of the fluorescent lamp. Dimming control can be achieved by the following three possible methods.

1) Constant dc Link Voltage with Variable Switching Frequency $S_1$ and $S_2$ are switched alternately. By controlling the switching frequency $f_{sw}$ of $S_1$ and $S_2$, the reactance of $L_r$ can be varied and therefore the lamp power can be adjusted.

2) Variable dc Link Voltage with Constant Switching Frequency

Instead of controlling the switching frequency, the lamp power is controlled by adjusting the magnitude of the dc link voltage (i.e., by controlling $V_{dc}$). $f_{sw}$ is chosen to be slightly higher than the resonant frequency of the resonant tank circuit.

3) Variable dc Link Voltage with Variable Switching Frequency

This method hybridizes the previous two methods. The methodology is based on using a lamp current controller to regulate the lamp current at a desired value under a dc link voltage.

The principle of the hybrid dimming control is to vary the inverter dc link voltage and the inverter switching frequency so as to control the lamp power in a desired manner. The following describes methods for vying the dc link voltage.

The dc link voltage $V_{dc}$ may be controlled by either monitoring the input voltage $V_{in}$ or the phase angle θ. FIG. 1 shows a functional block $f_1$, which uses do link voltage $V_{in}$ and/or the firing angle θ as the input parameters. It generates the required reference signal $v_{ref}$ (that is a variable) and compares it with the scaled-down inverter voltage $V_{dc}$. The scaling factor is K. $V_{ref}$ can be varied in order to vary the dc link voltage.

Figure 16:
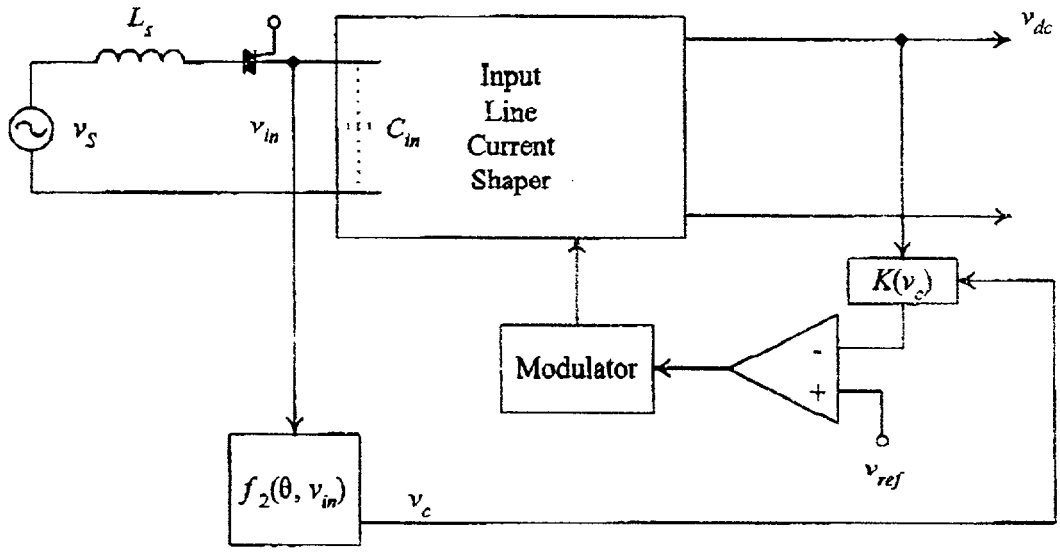
FIG. 16 shows schematically another method for controlling the dc link voltage.

An alternative way to implement the dc link voltage control is illustrated in FIG. 16. In this implementation, $V_{ref}$ is fixed and the scaling factor K is controllable. K is controlled by a control voltage signal $v_C$, which is derived from a function $f_2$. The input parameters of $f_2$ are $V_{in}$ and/or θ. That is, the scaling actor K in FIG. 16 is controlled according to the $V_{in}$ and/or θ.

In the above example using a boost converter as the input line current shaper, a hybrid control scheme is adopted as follows. As shown in FIG. 3, when $0 \leqq \theta \leqq 90°$, $V_{dc}$ is regulated at a relatively constant value. The lamp current is regulated to $I_{lamp,ref}$ (which is independent of $V_{in}$) by controlling $f_{sw}$ only. For θ>90°, $V_d$ is reduced and the lamp current controller will adjust $f_{sw}$ so that the lamp current will track $I_{lamp,ref}$. $f_{sw}$ can be increased, unchanged, or decreased (as shown in FIG. 3(*b*)).

It should be noted that the particular manner in which dc link voltage control and switching frequency control are combined to provide dimming control may depend on the particular nature of the converter topology used for the line shaper. In the above example a boost converter is used and therefore to ensure that the output voltage is always higher than the input voltage (which is necessary to ensure correct functioning of the converter) the dc link voltage is maintained higher than the peak input voltage for at least $0 \leqq \theta \leqq 90°$. For example if the mains is 220V ac supply (implying a peak at 90° of around 312V) then the dc link voltage may be kept at about 400V for that range, and then once the peak input voltage has passed the dc link voltage can be reduced. However, with the same circuit configuration operated with a 110V ac mains supply, since the peak would be only around 156V, it may be possible to decrease the dc link voltage over the entire firing angle range and still keep the dc link voltage higher than the converter input voltage at all times. With other forms of converter replacing the boost converter, eg step-up or step-down converters, it may also be possible to vary the dc link voltage throughout the firing range.

In practical terms to obtain dimming control over a very wide range of lamp powers, it is necessary to combine both dc link voltage control and switching frequency control over at least a part of the dimming range. This is particularly so at low power levels since, for example, to use switching frequency control alone to dim the power to less than, say 10%, would imply very high switching frequencies with as a consequence very expensive components. Furthermore, because lamp power decreases only in inverse proportion to switching frequency, as the switching frequency increases to very high levels the corresponding reduction in lamp power becomes smaller.

Figure 13A:
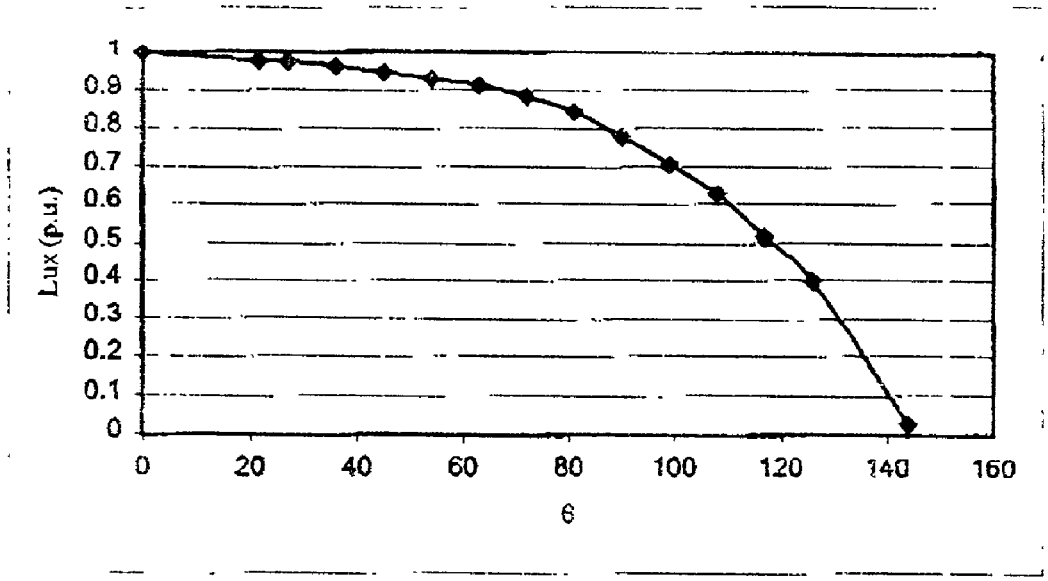
Figure 13B:
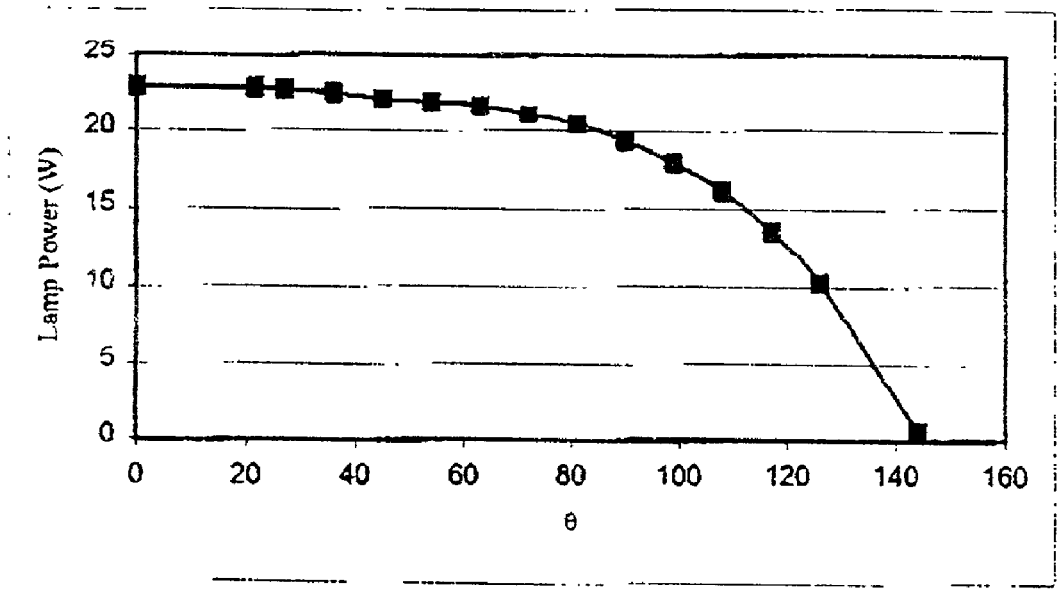

An experiment was carried out to examine the dimming range of a 25 W compact fluorescent lamp using the proposed EAS and the dimming control technique. Measurements were made when the lamp was still in the ON state. FIG. 13(*a*) and FIG. 13(*b*) show the measured light intensity (per unit) and lamp power over a range of the firing angle, respectively. A dimming range from 100% to about 3% has been achieved. The variations of light intensity and lamp power with the firing angle follow approximately a cosine waveform.

Figure 14A:
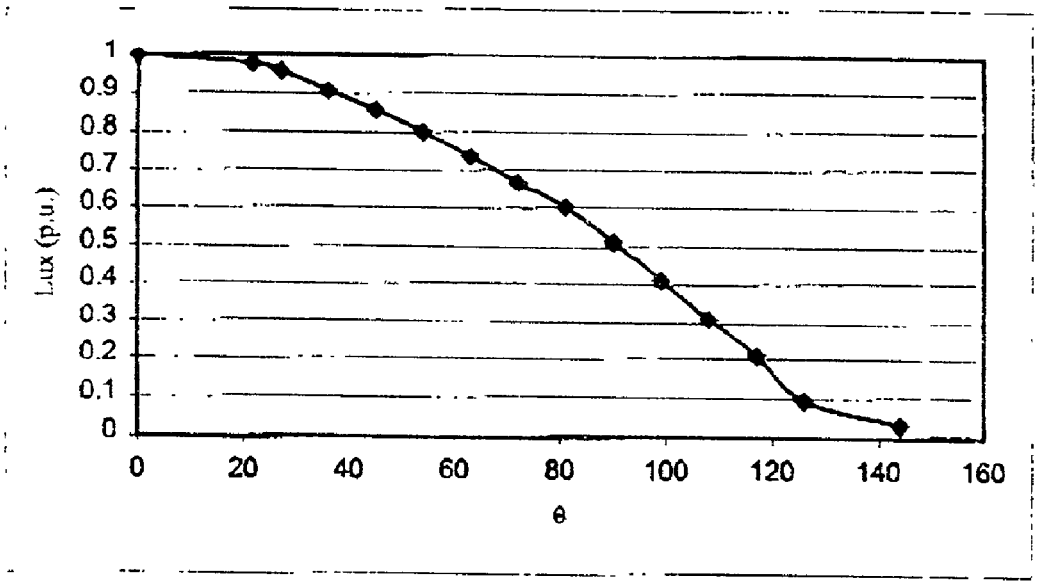
Figure 14B:
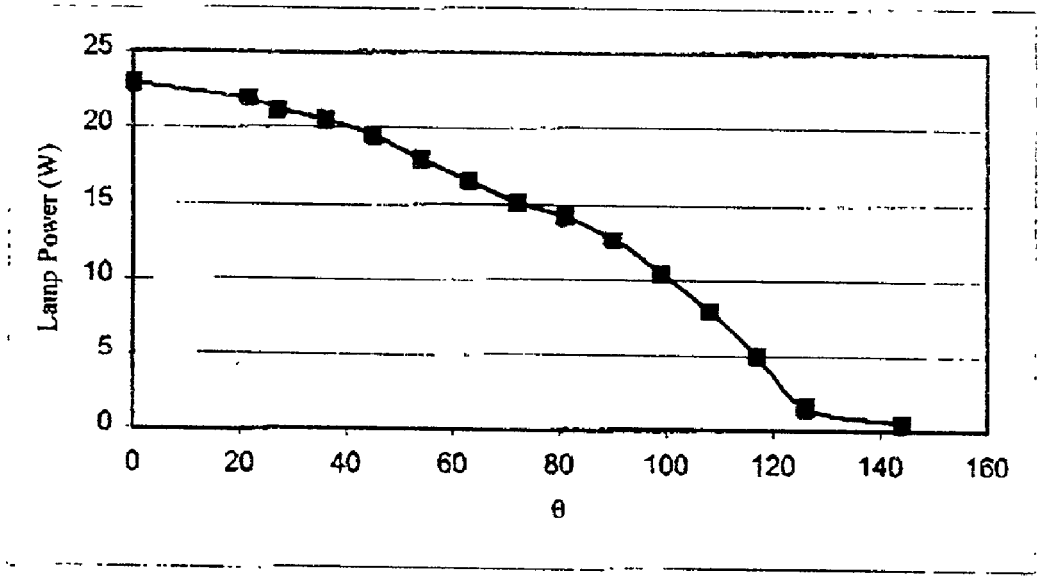
Figure 15:
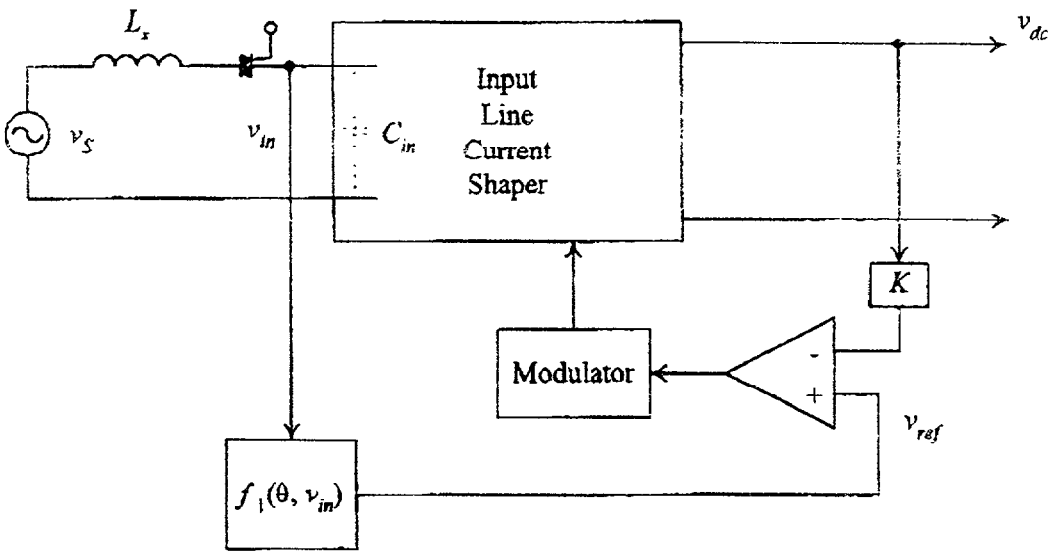
FIG. 15 shows schematically one method for controlling the dc link voltage.

The proposed control scheme here can incorporate a lamp power linearization technique as described in U.S. Ser. No. 09/883,151 the contents of which are herein incorporated by reference so as to alter the profile of the variations of the light intensity and lamp power with the firing angle. The variation of light intensity and lamp power with the firing angle can be linearized using the technique described in U.S. Ser. No. 09/883,151. FIG. 14(*a*) and FIG. 14(*b*) show the linearized variations the light intensity and lamp power with the firing angle.

The invention claimed is:

1. A method of providing phase controlled dimming control of a fluorescent lamp where said fluorescent lamp is controlled by an electronic ballast connected to a mains supply through a phase control means that controls an angular range of switch-on of said supply, wherein the angular range is varied variable between 0° and 180°, and wherein over at least a part of the angular range a lamp power is controlled by varying both a dc link voltage and a switching frequency of said ballast.

2. A method as claimed in claim 1 wherein over a first portion of the angular range the do link voltage is maintained fixed and the switching frequency is varied, and wherein over a remainder of the angular range both the dc link voltage and the switching frequency are varied.

3. A method as claimed in claim 2 wherein the first portion corresponds to an angular range of between 0° and 90°.

4. A method as claimed in claim 1 wherein said phase control means comprises a Triac.

5. A method as claimed in claim 4 further comprising suppressing transient oscillations of a Triac circuit when the Triac is switched on.

6. A method as claimed in claim 5 wherein said transient oscillations are suppressed by a dissipative energy absorption technique.

7. A method as claimed in claim 5 wherein said transient oscillations are suppressed by a non-dissipative energy absorption technique.

8. A method as claimed in claim 5 wherein said transient oscillations are suppressed by both dissipative and non-dissipative energy absorption techniques.

9. Apparatus for providing dimmable control of an electronic ballast of a fluorescent lamp, comprising means for connecting said ballast to an ac mains supply, phase control means connected between an input of said ballast and said mains supply for controlling an angular range of switch-on of said mains supply, an output inverter for regulating the fluorescent lamp, and means for providing a dc link voltage to said output inverter, wherein means are provided for over at least a part of the angular range varying simultaneously both the dc link voltage and a switching frequency of said output inverter in order to provide dimming control.

10. Apparatus as claimed in claim 9 wherein when said firing angle is in a first range said dc link voltage is kept fixed and said switching frequency is varied, and when said firing angle is in a second range both said dc link voltage and said switching frequency are varied.

11. Apparatus as claimed in claim 9 wherein said means for providing a dc link voltage comprises an input line current shaper.

12. Apparatus as claimed in claim 11 wherein said input line current shaper comprises a boost converter.

13. Apparatus as claimed in claim 12 wherein when said angular range is between 0° and 90° said dc link voltage is kept fixed and said switching frequency is varied, while when said angular range is greater than 90° both said dc link voltage and said switching frequency are varied.

14. Apparatus as claimed in claim 9 wherein said phase control means comprises a Triac.

15. Apparatus as claimed in claim 14 further comprising means for suppressing initial oscillations of said mac when said Triac is switched on.

16. Apparatus as claimed in claim 15 wherein said suppressing means comprises a dissipative energy absorption means.

17. Apparatus as claimed in claim 16 wherein said dissipative energy absorption means comprises a resistor-capacitor-diode circuit provided between said Triac and an input line current shaper, wherein a resistor a capacitor of said resistor-capacitor-diode circuit are connected in series and a diode thereof is connected in parallel with said resistor.

18. Apparatus as claimed in claim 16 wherein said dissipative energy absorption means comprises a resistor-capacitor-switch circuit provided between said Triac and an input line current shaper, wherein a resistor and a capacitor of said resistor-capacitor-switch circuit are connected in series and a switch thereof is connected in parallel to said resistor whereby after said initial oscillations have been suppressed said capacitor may be tied to earth and may function as part of an EMI filter.

19. Apparatus as claimed in claim 18 wherein said switch comprises a power Mosfet.

20. Apparatus as claimed in claim 16 wherein said dissipative energy absorption means comprises a resistor-capacitor-inductor circuit provided between said Triac and an input line current shaper, wherein a capacitor and a resistor of said resistor-capacitor-inductor circuit are connected in series and an inductor thereof is connected in parallel with said resistor and in series with a second resistor, whereby after said initial oscillations have been suppressed said capacitor may be tied to earth and may function as part of an EMI filter.

21. Apparatus as claimed in claim 15 wherein said suppressing means comprises a non-dissipative energy absorption means.

22. Apparatus as claimed in claim 21 wherein said non-dissipative energy absorption means comprises means for momentarily increasing an input current of a current shaper when the Triac is turned on.

23. Apparatus as claimed in claim 22 wherein said means for increasing the input current comprises means for differentiating a input voltage to said current shaper.

24. Apparatus as claimed in claim 15 said suppressing means comprises both dissipative and non-dissipative energy absorption means.

* * * * *